US005803890A

United States Patent [19]

Zechner

[11] Patent Number: 5,803,890

[45] Date of Patent: Sep. 8, 1998

[54] BUCKLE FOLDING MACHINE

[76] Inventor: Karl Zechner, Wiener Strasse 25, A-8630 Mariazell, Austria

[21] Appl. No.: 424,253

[22] PCT Filed: Oct. 13, 1993

[86] PCT No.: PCT/AT93/00154

§ 371 Date: Apr. 14, 1995

§ 102(e) Date: Apr. 14, 1995

[87] PCT Pub. No.: WO94/08882

PCT Pub. Date: Apr. 28, 1994

[30] Foreign Application Priority Data

Oct. 19, 1992 [AT] Austria ..... 2060/92

[51] Int. Cl.[6] ..... B65B 57/10; B31F 1/00; B65H 45/14

[52] U.S. Cl. ..... 493/419

[58] Field of Search ..... 493/419, 420, 493/421, 442, 443

[56] References Cited

U.S. PATENT DOCUMENTS

| | | | |
|---|---|---|---|
| 3,986,711 | 10/1976 | Anikanov et al. | 493/443 |
| 4,020,616 | 5/1977 | Nakajima | 493/419 |
| 4,218,052 | 8/1980 | Noren . | |
| 4,403,981 | 9/1983 | Wüthrich . | |
| 4,900,002 | 2/1990 | Zechner | 493/405 |

FOREIGN PATENT DOCUMENTS

| | | |
|---|---|---|
| 0 059 357 | 9/1985 | European Pat. Off. . |
| 27 57 182 | 6/1979 | Germany . |

*Primary Examiner*—Kurt Rowan
*Attorney, Agent, or Firm*—Collard & Roe, P.C.

[57] ABSTRACT

A buckle folding machine comprises a stationary machine frame (1) and four parallel working cylinders (3, 4, 5, 6) which have the same outside diameter and in pairs define at least two folding nips for the material to be folded and are adapted to be rotated at the same speed by a common transmission. It is proposed that the four working cylinders (3, 4, 5, 6) and the common transmission are arranged in the rotary frame (2), which is rotatably mounted in the machine frame (1) and is adapted to be rotated by a drive in order to draw in, fold and eject the material which is to be or has been folded. At least one of the working cylinders (3, 4, 5, 6) which revolve with the rotary frame is displaceable in said rotary frame. At least one of the working cylinders (3, 4, 5, 6) is adapted to be positively displaced within the rotary frame (2) by a mechanical control device. Means for drawing in the material to be folded are provided, which is associated with the first folding nip and cooperate with the rotary frame (2) during the drawing-in and folding operations.

33 Claims, 9 Drawing Sheets

BUCKLE FOLDING MACHINE

FIELD OF THE INVENTION

This invention relates to a buckle folding machine comprising a stationary machine frame and four parallel working cylinders, which have the same outside diameter and in pairs define at least two folding nips for the material to be folded and are adapted to be rotated at the same speed by a common transmission.

PRIOR ART

In a known buckle folding machine of that kind (German Patent Specification 2, 757, 182) the four working cylinders are rotatably mounted in stationary frame plates and operatively interconnected by gears. Three of said four working cylinders are so arranged that pairs of them define two folding nips, each of which is preceded by a feeding path, in which the material to be folded is received by two parallel guide plates and which is preceded by an electromagnetically pivotally movable feed limiter, whereas the fourth working cylinder consists only of a forwarding cylinder. The feed limiters consist of pressure-applying rollers and are pivotally moved by means of electromagnets and urge the material to be folded against that working cylinder which is adjacent to the associated feeding path so that the feed movement of the material to be folded is stopped before the succeeding folding operation and the direction of movement of that portion of the material to be folded which is being fed is reversed. The two electromagnets which impart the pivotal movement to the two feed limiters are actuated by electronic control means for a control of the folding operation in dependence of the length of the folds. Those control means receive pulses from an electronic pilse generator which is synchronized with the working cylinders and the signals from stationary sensors, which sense the material to be folded and detect the leading edge of each section of the material to be folded. In that known buckle folding machine, at least two electromagnets are required for the actuation of the feed limiters and together with the guide plates defining the feed path, the sensor for detecting the material to be folded and the electonic apparatus require the machine to have a certain minimum size.

SUMMARY OF THE INVENTION

It is an object of the invention to provide a novel buckle folding machine which is as small as possible.

In a buckle folding machine of the kind described first herein before this is accomplished in accordance with the invention in that the four working cylinders in the common transmission are provided in a rotary frame, which is rotatably mounted in the machine frame and is adapted to be rotated by a drive in order to draw in, fold, and eject the material which is to be or has been folded and in which at least one of the working cylinders revolving with said rotary frame is displaceable, that at least one of the working cylinders is adapted to be positively displaceable within the rotaty frame by means of a mechanical control device, and that means for drawing in the materials to be folded are associated with the first folding nip and arranged to cooperate with the rotaty frame during the drawing-in and folding operations.

The design in accordance with the invention provides for a mechanical control of both folding stations which are required for a zigzag fold and parallel fold by the rotating rotary frame. During an intermittent or continous rotation of the rotary frame the material to be folded is drawn in and folded and the folded material is ejected. Owing to the design in accordance with the invention the structure of the buckle folding machine is simplified and reduced in size because the parallel guide plates which define the feeding path are omitted. The feed movement of the material to be folded is arrested by a relative movement between the working cylinders, which act as buckling cylinders, and that relative movement is derived from the rotation of the rotary frame so that additional control means for actuating the feed limiters are not required. Owing to the design in accordance with the invention it is possible to fold even multi-ply material or stitched material so as to form a zigzag fold or a parallel fold or a single fold. The arrangement which is called for in accordance with the invention that the working cylinders are displaceable in the rotary frame may be selected in dependence on the thickness of the material to folded. By means of the control device for positively displacing the working cylinders within the rotary frame that roll nip which is diametrally opposite to the first folding nip can be opened to permit an unrestrained movement of the material to be folded and can be closed in time for the formation of the buckling loop for the second fold.

According for a further feature of the invention, a transfer transmission is provided for transmitting the drive from the rotating rotary frame to the working cylinders and in that transfer transmission at least one gear for driving the working cylinders revolving with the rotary frame meshes with a gear which is stationary in the machine frame and is coaxial to the axis of the rotary frame. That design provides a constant transmission ratio between the speed of the working cylinders and the speed of the rotary frame and carries the drive for the working cylinders to be derived from the drive for the rotary frame.

In accordance with the invention a working cylinder drive shaft which is coaxial to the drive shaft that is non-rotatably connected to the rotary frame may be provided and may serve to rotate the rotary frame and the working cylinders, and a gear which meshes with at least one drive gear for the working cylinders which revolve with the rotary frame may be non-rotatably connected to said working cylinder drive shaft. In accordance with the invention said drive shafts may be disengageably interconnected by a clutch, which will be used to advantage in a buckle folding machine in accordance with the invention that comprises electronic control means which are programmable as regards the kind of folds and fold leg sizes and in which machine only one drive motor is provided and it is desirable to uncouple the drive for the working cylinders. According to a further feature of the invention the drive for the working cylinders comprises a drive shaft which is rotatable relative to the rotary frame and to which a gear is non-rotatably connected which the meshes with at least one drive gear of the working cylinders which revolve with the rotary frame. That design will be of advantage in a buckle folding machine in which the working cylinders and the rotary frame are driven by separate drive motors. That design permits also a change of the transmission ratio between the speed of the working cylinders and the speed of the rotary frame by a change of the motor speed of one drive motor or both drive motors for a control of the lengths of the fold legs if the material to be folded has different lengths.

In accordance with the invention the drive shaft for driving the working cylinders which is rotatable relative to the rotary frame may be coupled to the drive for the rotary frame. This permits an embodiment of the buckle folding machine in which a single drive motor drives two parallel belt drives, one of which directly drives the rotary frame whereas the other belt drive drives the drive shaft for the working cylinders. The transmission ratio between the speed of the working cylinders and the speed of the rotary frame is determined by two belt drives.

It is also possible to permit the drive of the drive shaft for the working cylinders to be uncoupled from the drive for the rotary frame. In that case the buckle folding machine may be provided with a single drive motor and two parallel belt drives for the rotary frame and the working cylinders, respectively, and one of said belt drives may be connected and disconnected, e.g., by means of a clutch on the drive shaft of the motor.

In accordance with a further feature of the invention the rotary frame comprises two rotary heads which are disposed at opposite ends of the working cylinders rotatably mounted in the machine frame and at least one of which consists of a driven rotary head, in which the transmission for driving the working cylinders is provided, and each rotary head comprises guide elements, which are movable relative to the rotary head against the force of at least one spring and each of which is provided with at least one of the journals of at least one of the displaceable working cylinders. That design in accordance with the invention permits the buckle folding machine to have a particularly compact structure. The guide elements which are movable against spring force and serve to guide the displaceable working cylinder permit the working cylinders to be displaced during the folding operation in adaptation to the thickness of a given material to be folded so that the materials to be folded which differ in thickness may be folded in close succession. The displacements of the guide elements against spring force in both rotary heads are effected independently of each other and permit also a folding of material which is stitched at one edge.

In accordance with the further feature of the invention the guide elements may consist of carriages, which are substantially radially displaceable in the rotary heads. In that design the displacement of one guide element and of the associated working cylinder will result in an opening of the roll nips on both sides of the working cylinder.

A further feature of the invention resides in that the guide elements consist of pivoted levers having pivotal axes which are parallel to the axis of the rotary frame. In that case the journal of an adjacent working cylinder may desirably constitute a pivot for the pivoted lever.

According to a further feature of the invention the guide elements may consist of disks and may be tiltable about at least one pivot which is eccentric to the axle for the associated working cylinder.

In accordance with the invention, adjacent guide elements of each pair thereof may be interconnected by a common spring. In an alternative it is possible in accordance with the invention that all guide elements of the rotary head are interconnected by a common spring.

In accordance with a further feature of the invention the spring connecting all guide elements of the rotary head may consist of an endless ring, which is made of elastic material and extends along the outside peripheries of the guide elements. That ring may consist of a rubber ring or a rubber hose or a helical tension spring, which opposes the displacement of working cylinders in the rotary frame.

A further feature of the invention resides in that the rotary head comprises a frame disk which is adjacent to the ends of the working cylinders and through which the journals of the working cylinders extend and on which the guide elements as well as the springs biasing them are provided on that side of said disk which faces away from working cylinders. By that arrangement an ingress of material to be folded between the guide elements and the spring will be prevented as well as an escape of abraded fines or dirt from the rotary head into the interior of the folding machine, which interior is to be passed through by the material to be folded.

In accordance with the invention it may also be contemplated that the driving rotary head comprises a frame disk, which is adjacent to the ends of the working cylinders and through which the journals of the working cylinders extend and on which the drive gears of the working cylinders and the associated common transmission are provided on that side of said disk which faces away from working cylinders. That design will prevent an ingress of material to be folded into the transmission space of the driving rotary head.

In accordance with a further feature of the invention the mechanical control device comprises at least one camwheel, which is coaxial to the axis of the rotary frame and is stationary with respect to the machine housing or adapted to be fixed thereto and comprises at least one cam track which has at least one cam portion, which is associated with the positive displacement of one of the working cylinders and the control device comprises at least one control element which is engageable with the cam track and is associated with the guide element for that associated working cylinder which is to be positively displaced. The camwheel may consist of a plate, which is included in the machine housing and extends at right angles to the axis of the rotary frame and comprises a track, which is closed in itself and faces the axis of the rotary frame and is provided with step-shaped cam portion which is associated with the positive displacement of the working rollers and engaged by the outer control elements for controlling guide elements for the working cylinders which revolve with the rotary frame, which guide elements are resiliently urged outwardly with respect to the axis of the rotary frame.

A further feature of the invention resides in that cam portion of the cam track which is associated with the positive displacement of the working cylinders consists of a spreading cam, which protrudes outwardly from a cylinder which is coaxial to the axis of the rotary frame. That design will be of advantage if guide elements are provided which are resiliently biased toward the axis of the rotary frame as well as associated inwardly disposed control elements which engage the spreading cam during the rotation of the rotary frame.

According to a further feature of the invention the control device comprises for a simultaneous positive displacement of two adjacent working cylinders, a control element which is engageable with the cam track and the guide elements for the two adjacent working cylinders at the same time and consists of a spreading element for moving the two guide elements apart. With that design the roll nip between the two working cylinders may be uniformly opened toward both sides at the same time by the spreading element, which is displaceable in the plane of the roll nip.

A further feature of the invention resides in that a rejector for rejecting the material to be folded is provided, which protrudes between the four working cylinders into the rotary frame and is associated with the second folding nip and is adapted to be fixed to the machine housing preferably in different angular positions. That design will be of advantage in a buckle folding machine in which one pass of the material is to be folded is effected per revolution of the rotary frame through 180° and permits the rejector for rejecting the material to be folded to be adjusted to a position depending on the nature of the fold.

A further feature of the invention resides in that a rejector for rejecting the material to be folded is provided, which protrudes between the four working cylinders into the rotary frame and is associated with the second folding nip and is adapted to be fixed to the rotary frame preferably in different angular positions. That design will be of advantage in a buckle folding machine in which one pass of the material to be folded is effected per revolution of the rotary frame through 360° and permits the rejector for rejecting the material to be folded to be adjusted to a position depending on the nature of the fold.

According to a further feature of the invention the means for drawing in the material to be folded may comprise two forwarding rollers, which are movable arranged in the machine frame and are resiliently biased toward the rotary frame and adapted to be forced against the working cylinders of the rotary frame. Said forwarding rollers may be guided to be individually displaceable in the longitudinal slots provided in the machine frame.

According to a further feature of the invention the two forwarding rollers rotatably mounted in a pressure-applying frame, which is movably guided in the machine frame and is resiliently biased to the rotary frame and carries lateral guide rollers for engaging guiding surfaces, which are formed on outwardly facing perpheral surfaces of the rotary frame. That design will simplify the cooperation between the means for drawing in the material to be folded and the rotary frame.

To permit a restriction of the engagement between the forwarding rollers and the working cylinders to the first folding operation. If it is possible in accordance with the invention to provide the guide surfaces of the rotary frame adjacent to those working cylinders which define the second folding nip with a cam portion, which keeps the pair of forwarding rollers away from the working cylinders defining the second folding nip A further feature of the invention resides in that the means for drawing in the material to be folded comprise an outer guide member, which is preferably connected to the pressure-applying frame and constitutes outer confining means defining a shaft for the material to be drawn in and to be folded, whereas the inner confining means defining said shaft are constituted by an inner guide member, which is attached to that edge portion of and revolves with the rotary frame which is associated with the second folding nip.

According to a further feature of the invention the means for drawing in the material to be folded may comprise a locating mark for locating the material to be folded, which mark is preferably provided with a sensor for detecting the material to be folded. That design will facilitate the correct infeeding of the material to be folded. The provision of the sensor for detecting the material to be folded will permit an actuation of the buckle folding machine by the material to be folded.

To permit a folding of different materials with different fold leg lengths, it is possible in accordance with the invention to provide the locating mark on a U-shaped stop member, which is pivotally movable relative to the axis of the rotary frame and adapted to be fixed to the machine housing.

According to a further feature of the invention a simultaneous adjustment of the fold leg lengths of the first and second folds is permitted by the provision of a transmission, which connects the pivoted U-shaped stop member of the means for drawing in the material to be folded to the rotatable camwheel of the mechanical control device. In that case the first and second folds can be positioned in dependence on the length of the material to be folded.

A further feature of the invention resides in that a stopless guide for the material to be folded is constituted by an enclosure which is provided in the machine frame and surrounds the rotary frame and leaves free only the region containing the means for drawing in the material to be folded and the means for ejecting the folded material. With that design a buckle folding machine can be provided which is very compact and in which only the space required for the forwarding of the material to be folded is provided between the rotary frame and said enclosure.

The invention will subsequently be explained in more detail with reference to illustrative embodiments shown in the drawings.

DESCRIPTION OF ILLUSTRATIVE EMBODIMENTS

Figure 1:
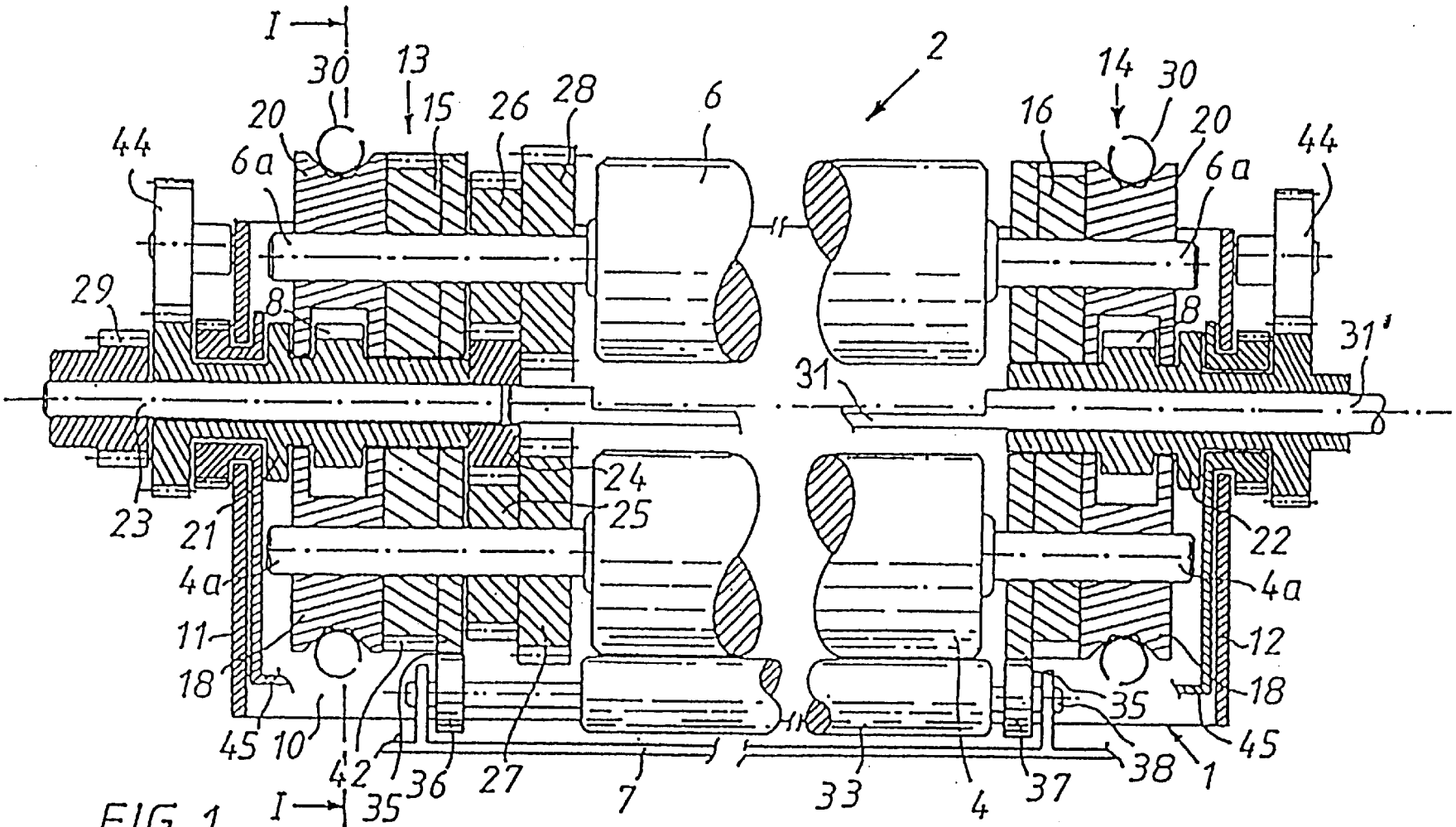
FIG. 1 is a longitudinal sectional view showing a first embodiment of a buckle folding machine comprising two rotary heads, FIG. 2 a side elevation showing the buckle folding machine of FIG. 1, FIG. 3 a sectional view showing the buckle folding machine of FIG. 1, FIG. 4 a simplified schematic sectional view taken on line I—I in FIG. 1 and showing tiltable guide elements for displacing the working cylinders and a spreading cam of the control device for positively displacing the working cylinders, FIG. 5 a sectional view showing a spreading cam of the mechanical control device for positively displacing the working cylinders, which cam is movably mounted on the rotary head axle, FIG. 6 a view showing the embodiment of FIG. 1 in its start position with a drawing-in shaft for the material to be folded, FIG. 7 a perspective view showing a rejector for rejecting the material to be folded, FIG. 8 a sectional view showing embodiment of a buckle folding machine comprising levers, which are pivoted to the rotary frame and serve to positively displace the working cylinders, FIG. 9 a schematic side elevation showing the buckle folding machine of FIG. 8, FIG. 10 a schematic side elevation showing another illustrative embodiment of a buckle folding machine comprising levers which are movable in the rotary frame and serve to positively displace the working cylinders, FIG. 11 a sectional view showing the drive end of the buckle folding machine of FIG. 10, FIG. 12 a schematic side elevation showing a further embodiment of a buckle folding machine comprising carriages which are movable in the rotary frame and serve to displace the working cylinders and FIG. 13 a schematic end elevation showing a lateral end of the buckle folding machine of FIG. 12.
Figure 3:
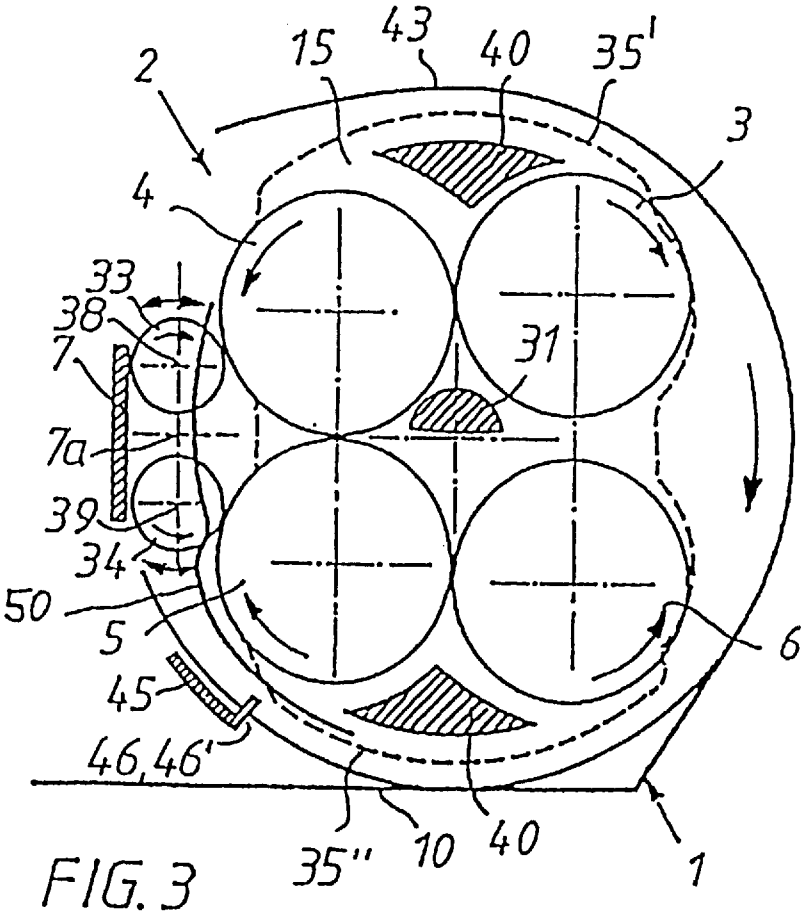
Figure 2:
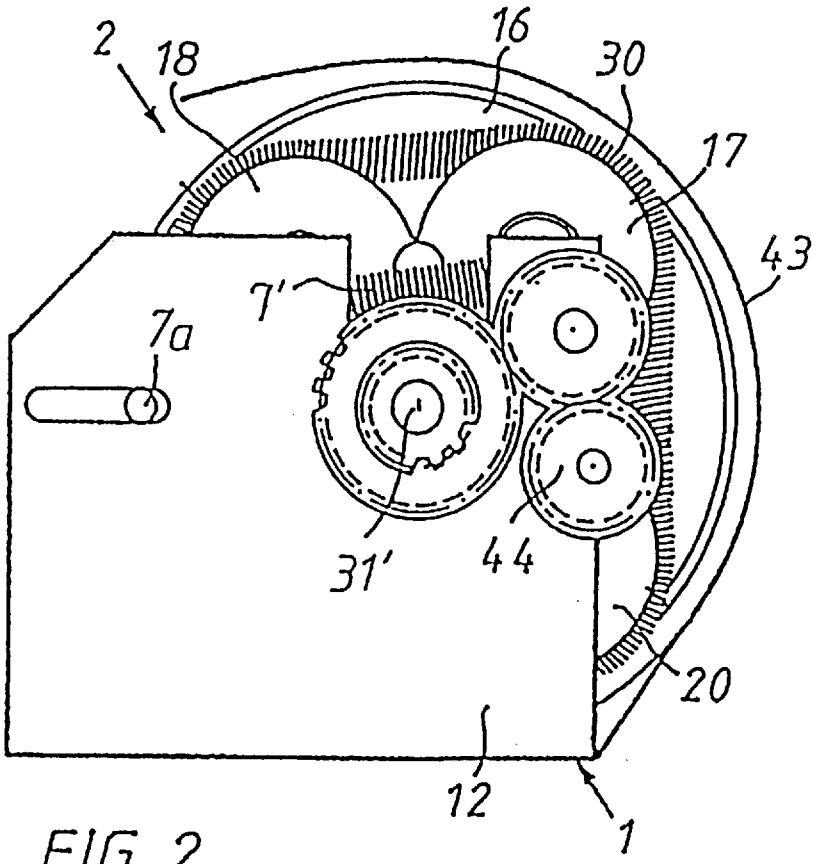

FIGS. 1 to 4 show a buckle folding machine comprising a stationary machine frame 1, in which a rotary frame 2 is rotatably mounted, which contains four parallel working cylinders 3, 4, 5, 6,which have the same outside diameter and in order to fold the material 9 cooperate with a pair of forwarding rollers 33, 34, which are rotatably mounted in a pressure-applying frame 7. The machine frame 1 essentially consists of a base plate 10, in which two spaced apart side plates 11,12 are mounted, which are at right angles to the base plate 10 and between which the rotary frame 2 is disposed, which carries the working cylinders 3, 4, 5, 6. The working cylinders 3, 4, 5, 6 are provided at both ends with journals 3*a*, 4*a*, 5*a*, 6*a*, which are rotatably mounted in lateral rotary heads 13, 14 of the rotary frame 2. The two rotary heads 13, 14 are rotatably mounted in the side plates 11, 12 by means of rotary head axles 21, 22. Each rotary head 13, 14 comprises a frame disk 15, 16, which is adjacent to the associated ends of the working cylinders 3, 4, 5, 6 and through which the journals 3*a*, 4*a*, 5*a*, 6*a* of the working cylinders extend and which is rotatably mounted on the associated rotary head axle.

Each rotary head 13, 14 is provided with the disklike guide element 17, 18, 19, 20 on that side of the frame disks 15, 16 which faces away from the end of the working cylinders 3, 4, 5, 6. One of the journals 3*a*, 4*a*, 5*a*, 6*a* of the working cylinders 3, 4, 5, 6 is rotatably mounted in each or said guide elements. On that side which faces the rotary head axle 21, 22 the guide elements 17, 18, 19, 20 are engaged in pairs with four pivots 17*a*, 18*a*, 19*a*, 48, which are provided on the frame disk .15, 16 and spaced apart in a circle about the rotary head axle 21, 22. Each of the recesses which are formed in the guide elements 17, 18, 19, 20 and associated with the pivots 17*a*, 18*a*, 19*a*, 48 is eccentric to the journal 3*a*, 4*a*, 5*a*, 6*a* of that working cylinder 3, 4, 5, or 6 which is mounted in the respective guide element. Each of the said pivots 17*a*, 18*a*, 19*a*, 48 is associated with two adjacent guide elements 17, 18, 19, 20 and is disposed in the respective rotary head 13, 14 adjacent to that roll nip which is defined by the working cylinders of the adjacent guide elements. The three pivots 17*a*, 18*a*, 19*a* are secured to the respective frame disk 13, 14. The fourth pivot 48 constitutes a control element of the mechanical control device for a positive displacement of working cylinders. The fourth pivot 48 is constituted by a roller, which is displaceable in the rotary frame and which may be forced as a spreading element between the two guide elements 17 and 20 in order to tilt apart the guide elements 17 and 20 and the working cylinder rotatably mounted in said guide elements 17 and 20. By a tilting movement of the corresponding guide element about one of the two associated pivots, each working cylinder can be lifted from the periphery of the two adjacent working cylinders in alternation. This may be effected by the material to be folded, e.g., by staples of the like, or by the mechanical control device for a positive displacement of working cylinders. To permit said tilting movements the frame disks 15, 16 are provided with apertures (not shown) for receiving the journals 3*a*, 4*a*, 5*a*, 6*a* of the working cylinders.

The rotary head shown on the left in FIG. 1 constitutes a driving rotary head 13, which contains the drive for the working cylinders 3, 4, 5, 6 and is connected to a drive motor. That driving rotary head 13 comprises a rotary head axle 21, which consists of a tubular shaft and is rotatably mounted in the side plate 11 of the stationary frame 1 and extends through that side plate 11 from the inside to the outside. A cylinder-driving shaft 23 consisting of a solid shaft extends through the rotary head axle 21 and at its inner end carries a pinion 24 for driving the working cylinders 3, 4, 5, 6 and at its outer end is connected by a gear 29 to the motor (not shown). The drive pinion 24 mounted on the inner end of the cylinder-driving shaft 23 meshes with two gears 25, 26, which are mounted each on one of the journals 4*a* and 6*a*. The gears 27 ans 28 for driving the working cylinders 4 and 6 are also mounted on said journals 4*a* and 6*a* and mesh with respective drive gears (not shown), which are mounted on the journals 3*a* and 5*a* of the two adjacent working cylinders 3 and 5. Said four drive gears which are mounted on respective journals have the same size and constantly mesh with each other and said meshing will be maintained as the working cylinders are tilted about the respective pivots 17*a*, 18*a*, 19*a*, 48 because a simultaneous tilting movement of the two diametrically opposite working cylinders 4 and 6 is not called for by the configuration of the fold so that at least one of the two gears 25, 26 mounted on the journals 4*a* and 6*a* is constantly in mesh with the driving pinion 24.

Figure 15:
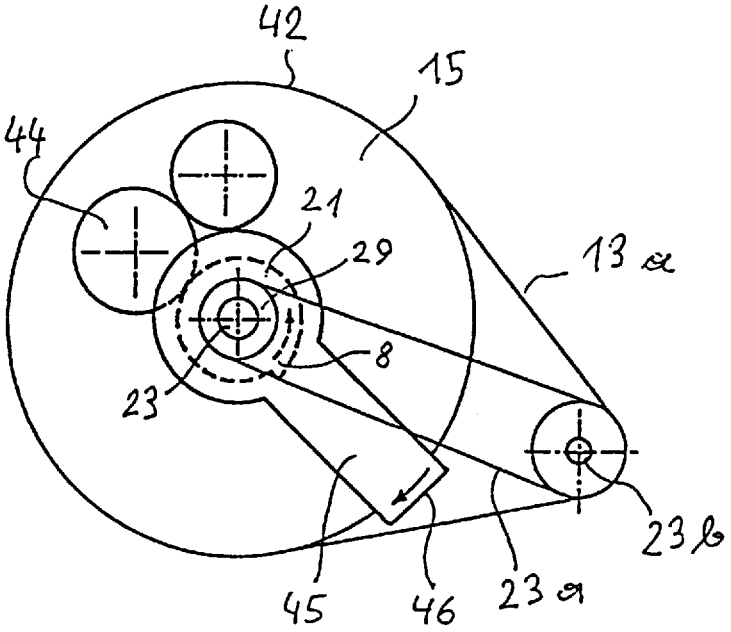
FIG. 15 is an elevation showing the drive side of the buckle folding machine of FIG. 1.

When the rotary head axle 21 is stationary the driving rotary head 13 is driven by a belt drive 13*a* acting on a peripheral surface 42 of the disk 15 of the rotary frame. The belt drive 13*a* is driven by a motor drive shaft 13*b*, which drives also a belt drive 23*a* for driving the cylinder-driving shaft 23 (FIG. 15). The tilting movements of the four guide elements 17, 18, 19, 20 is opposed by a tension spring 30 or an O-ring,which extends along the outside of the four guide elements and urges the four guide elements 17, 18, 19, 20 against the pivots 17*a*, 18*a*, 19*a*, 48 and, as a result, urges the four working cylinders 3, 4, 5, 6 against each other. The tension spring 30 also urges the guide elements 17, 18, 19, 20 against the associated pivots 17*a*, 18*a*, 19*a* of the frame disk 15, which pivots permit the four guide elements to tilt and also provide a non-positive connection between the frame disk 15 and the working cylinders 3, 4, 5, 6. The guide elements are urged by the tension spring 30 against the associated pivots until at least one guide element has been tilted either in that the material to be folded forces adjacent working cylinders apart or by a spreading cam 8 of the mechanical control device for a positive displacement of working cylinders. That spreading cam 8 is mounted on the rotary head axle 21, which is rotatably mounted in the side plate 11, and that cam 8 together with the roller 48 constitutes a mechanical control device for positively displacing the working cylinders 3 and 6.

Figure 7:
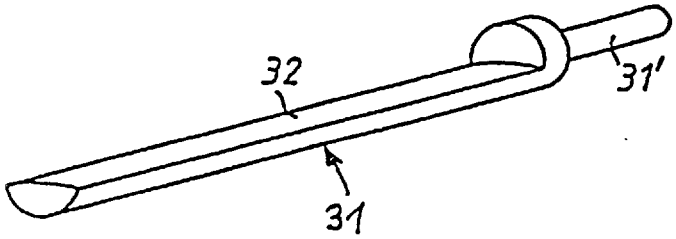

The rotary head 14 shown on the right in FIG. 1 comprises the frame disk 16, the four guide elements 17, 18, 19, 20, the pivots 17*a*, 18*a*, 19 and the roller 48, and the rotary head shaft 22, which is rotatably mounted in the side plate 12,as well as a rejector 31 for rejecting the material to be folded. That rejector is secured to an adjusting shaft 31', which is coaxial to the axis of rotation. The rejector protrudes into the free space between the working cylinders 3, 4, 5, 6. That rejector 31 for rejecting the material to be folded comprises a rejecting surface 32 (FIG. 7), which is eccentric and parallel to the axis of the rotation of the rotary frame and has an angular position which is adjustable by adjusting means, not shown.

The pressure-applying frame 7 contains the two forwarding rollers 33, 34, which have a smaller outside diameter than the working cylinders 3, 4, 5, 6, and is mounted in the machine frame to be displaceable and to be pivotally movable to a limited extent about the pivot 7*a*, which is displaceably mounted in the side plate 12. By means of a tension spring 7' acting on the pressure-applying frame the forwarding rollers are biased against the associated working cylinders 3, 4, 5, 6 of the rotary frame. The peripheral surface 35 of the frame disk 15 constitutes a guiding surface, on which control rollers 36, 37 roll, which are mounted on the journals. 38, 39 of the forwarding rollers 33, 34 and guide the forwarding rollers 33, 34 by means of the guide members 40 of the drawing-in shaft 41 during the rotation of the rotary frame 2. The rotary frame is surrounded by an enclosure 43, which leaves free only the regions in which the material to be folded is drawn in and the folded material is ejected, respectively. The peripheral surface 35 of each of the frame disks 15 and 16 constitutes a surface for guiding the forwarding rollers 33, 34 and adjacent to those working cylinders 3, 4 or 5, 6 which define the second folding nip may comprise a cam portion 35', 35", which keeps the two forwarding rollers 32, 34 away from the working cylinders 3, 4 and 5, 6 which define the second folding nip.

The rotary head axles 21, 22, which are rotatably mounted in the side plates 11, 12 and provided with the spreading cams 8 of the mechanical control device for positively displacing working cylinders are connected by a transmission 44 to a pivoted U-shaped stop member 45. A sensor 46' for detecting material to be folded is provided on the level of the locating mark 46 provided on the U-shaped stop member 45.

Figure 4:
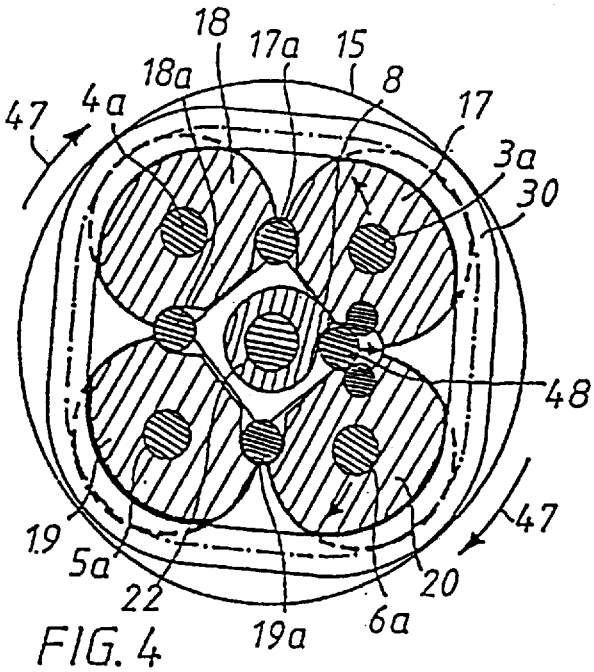
Figure 6:
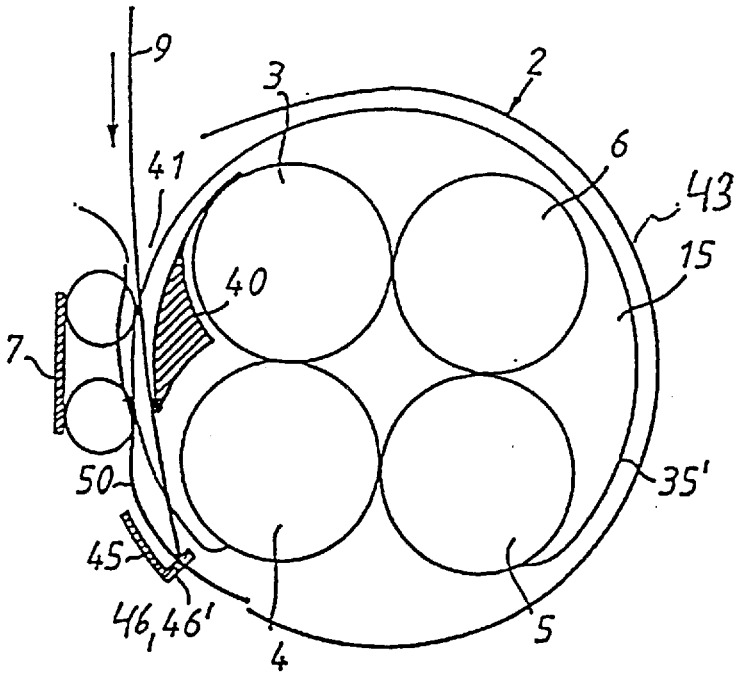

The arrows 47 in FIG. 4 indicate the sense of rotation of the rotary frame 2. FIG. 6 indicates the direction in which the paper is drawn in oppositely to that sense of rotation. FIG. 4 shows also an illustrative embodiment of the mechanical control device for positively displacing working cylinders by a radial movement of a spreading element 48 consisting of a roller and constituting a control element of the control device for use, when the rotary frame 2 is to be rotated through 360°.

Figure 5:
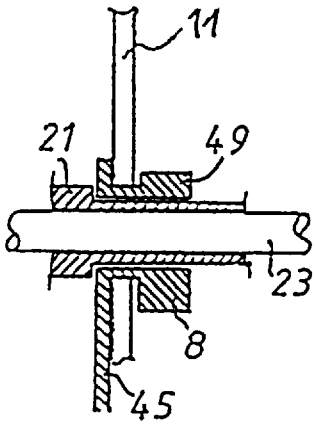

FIG. 5 shows an embodiment of a rigid rotary head axle 21 on which a tubular shaft 49 is rotatably mounted, which constitutes a control cylinder of the control device and at its inner end facing the rotary frame 2 comprises a spreading cam 8 for engaging the control elements for controlling the guide elements 17, 18, 19, 20 whereas the pivoted U-shaped stop member 45 is secured to the outer end of the tubular shaft 49.

Figure 17:
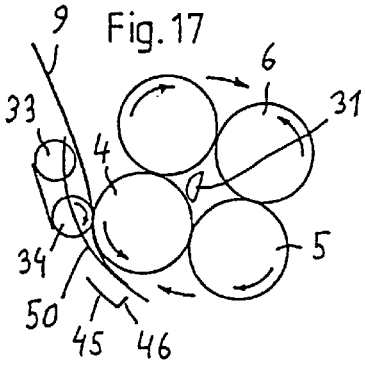
Figure 18:
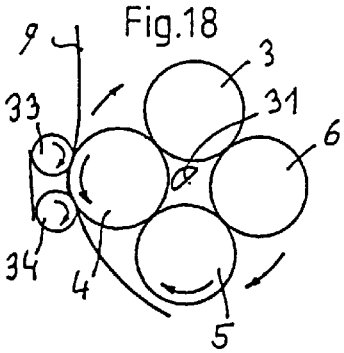
Figure 22:
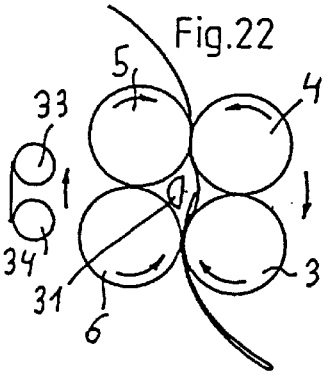

The initial position of the our working cylinders 3, 4, 5, 6 in the rotary frame 2 as well as the drawing-shaft 41 and the material 9 to be folded is shown in FIG. 6. In that case the material to be folded is introduced between the guide member 40 and the guide member 50 until said material has reached the locating mark 46 on the U-shaped stop member 45. The guide member 40 extends between and is secured to the two frame disks 15, 16 and is parallel to the axes of rotation of the working cylinders and revolves in unison with the rotary frame 2. When the rotation of the rotary frame 2 has been initiated, the pressure-applying frame 7 which carries the forwarding rollers and is guided toward the rotary frame 2 causes the material to be folded to be lifted from the locating mark 46 by the guide member 50 and that material is subsequently drawn in further in that the working cylinder 4 is urged against the forwarding rollers (FIGS. 17, 18).

Figure 8:
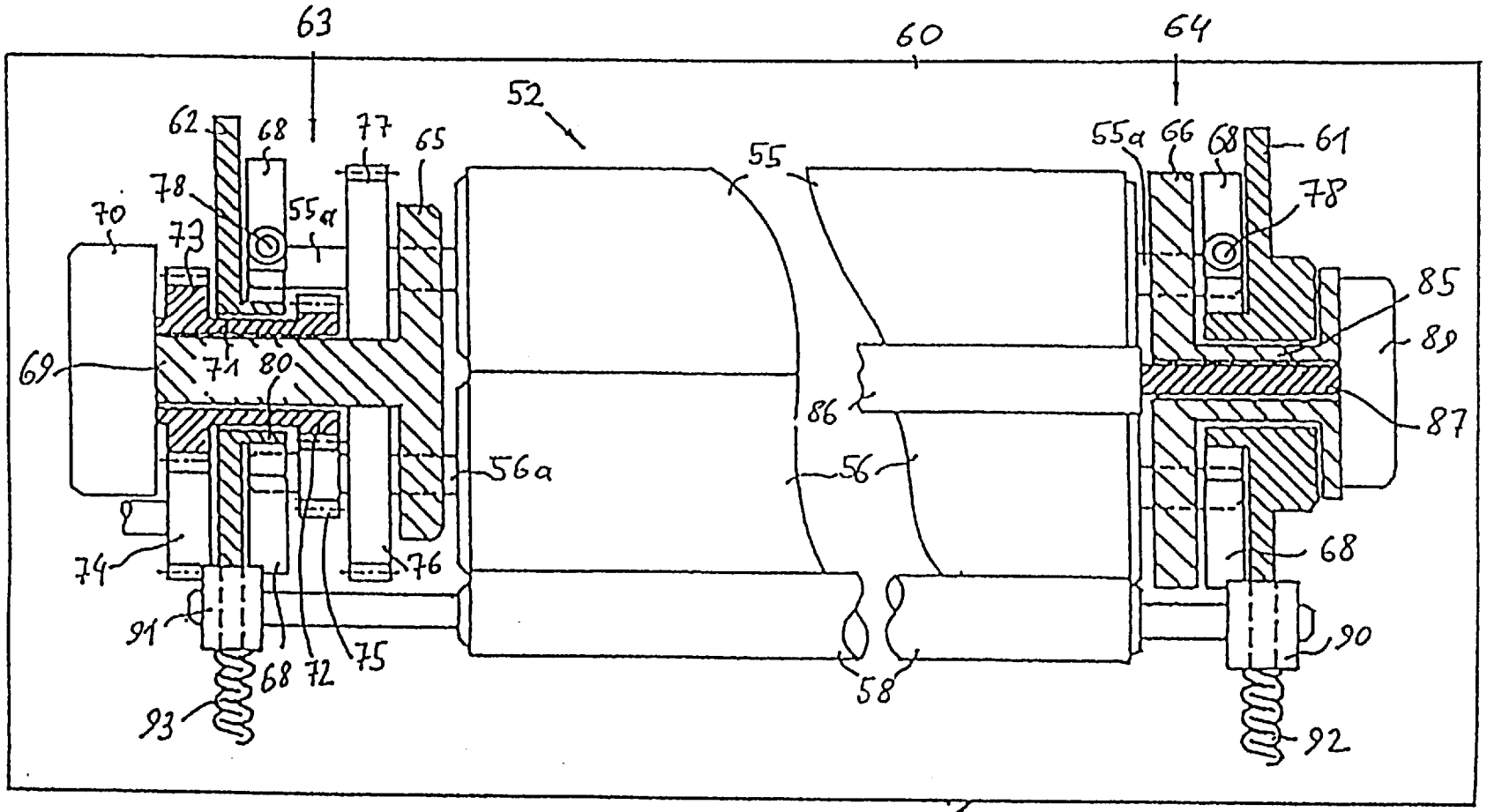
Figure 9:
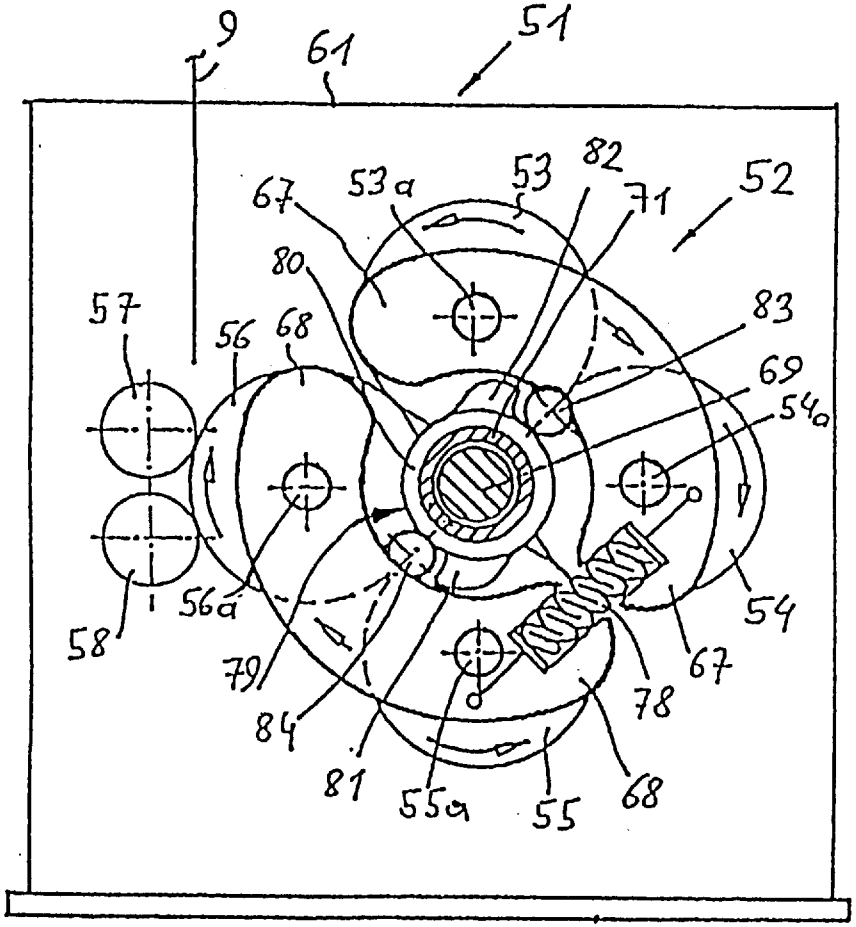

FIGS. 8 and 9 show another embodiment of the buckle folding machine comprising a rotary frame 52, which is rotatably mounted in a stationary machine frame 51 and contains four parallel rotating working cylinders 53, 54, 55, 56, which have the same outside diameter and cooperate with two forwarding rollers 57, 58, which are displaceable in the machine frame 51 and act as drawing-in rollers and buckling rollers. In that illustrative embodiment each rotary head 63, 64 comprises two pivoted arcuate members 67, 68, which are disposed on that side of the frame disk 65, 66 which faces away from the ends of the working cylinders 53, 54, 55, 56 and in each of which the journals 53*a*, 54*a*, or 55*a*, 56*a* of two adjacent working cylinders 53, 54 or 55, 56 are rotatably mounted and which permit a positive displacement of one working cylinder 54 or 55 by a pivotal movement of the pivoted arcuate member 67 or 68 about the journal 53*a* or 56*a* of the respective other working cylinder. Only one of the two working cylinders 53, 54 or 55, 56 which are connected by a pivoted arcuate member 67 or 68, i.e., only the working cylinder 53 or 56, and the associated journals 53*a* and 56*a* are rotatably mounted also in the adjacent frame disk 65 or 66 of the rotary head 63, 64. For the journals 54*a*, 55*a* of the other pivoted working cylinders 54, 55 the frame disks 65, 66 are provided with corresponding apertures, which are not shown and permit said pivotal movement.

The rotary head shown on the left in FIG. 8 constitutes a driving rotary head 63, which comprises the drive for the working cylinders 53, 54, 55, 56, which drive comprises the gears 72, 75, 76, 77, and is connected to a drive motor, not shown. That driving rotary head 63 comprises a split rotary head drive shaft, which is rotatably mounted in the side wall 62 of the machine frame 51 and extends through that side wall 62 from the inside to the outside. The rotary head drive shaft consists of a solid shaft 69, which carries at its inner end the frame disk 65 and at its outer end a clutch 70, and also comprises a coaxial tubular shaft 71, which at its inner end carries a pinion 72, which serves to drive the working cylinders 53, 54, 55, 56 and meshes with a gear 75 mounted on the journal 56*a*. A gear 73 is mounted on the outer portion of the tubular shaft 71 and meshes with a pinion 74, which is driven by the motor, not shown.

In the two rotary head 63 and 64 the two working cylinders 53 and 54 are interconnected by a first pivoted U-shaped member 67 and the working cylinders 55 and 56 are interconnected by a second pivoted U-shaped member 68. Because the two working cylinders 53 and 56 are rotatably mounted in the two frame disks 65 and 66, only each of the two working cylinders 54 and 55 can be pivotally moved apart along the periphery of the associated working cylinder 53 or 56 which is connected by the associated pivoted U-shaped member 67 or 68. That pivotal movement is opposed by a tension spring 78, which acts on each of the two pivoted levers 67, 68 at that end portion which is adjacent to the journal 54*a* or 55*a* of that working cylinder 54 or 55 which is pivotally movable relative to the rotary frame 52. The tension spring 78 maintains the engagement between the two pivoted working cylinders 54, 55 until the two pivoted levers 67, 68 have been forced apart by a spreading element 79 of the mechanical control device for positively working cylinders. That spreading element 79 is mounted on a sleevelike extension 80, which consists of a control cylinder and protrudes inwardly from the side plate 62. The spreading element 79 comprises two spreading cams 81, 82, which are diametrically opposite to each other and cooperate with control elements 83, 84 provided on the inside of the pivoted levers 67, 68.

The rotary head 64 shown on the right in FIG. 8 comprises a rejector 86 for deflecting the material to be folded. That rejector 86 is parallel to the axis of rotation of the rotary frame 52 and revolves in unison with the rotary head 64 and is secured to an adjusting shaft 87, which is coaxial to the axis of rotation. That rejector 86 protrudes into the free space between the four working cylinders 53, 54, 55, 56. That rejector 86 for rejecting the material to be folded comprises a planar rejecting surface, which is eccentric and parallel to the axis of rotation of the rotary frame and has relative to the rotary head 64 an angular position which is adjustable by an adjusting device 89, which is only schematically indicated.

The forwarding rollers 57, 58 acting as a drawing-in roller and buckling roller have a smaller outside diameter than the four working cylinders 53, 54, 55, 56 and are displaceably mounted in the machine frame 51. The two forwarding rollers 57, 58 are biased by associated compression springs to the respective operating positions for engaging one of the working cylinders 53, 54, 55, 56 of the rotary frame. FIG. 8 shows the compression springs 92, 93, which act on the lateral bearing bushings 90, 91 for the forwarding roller 58, which are displaceably mounted in the side plates 61, 62 of the stationary frame 51.

Figure 10:
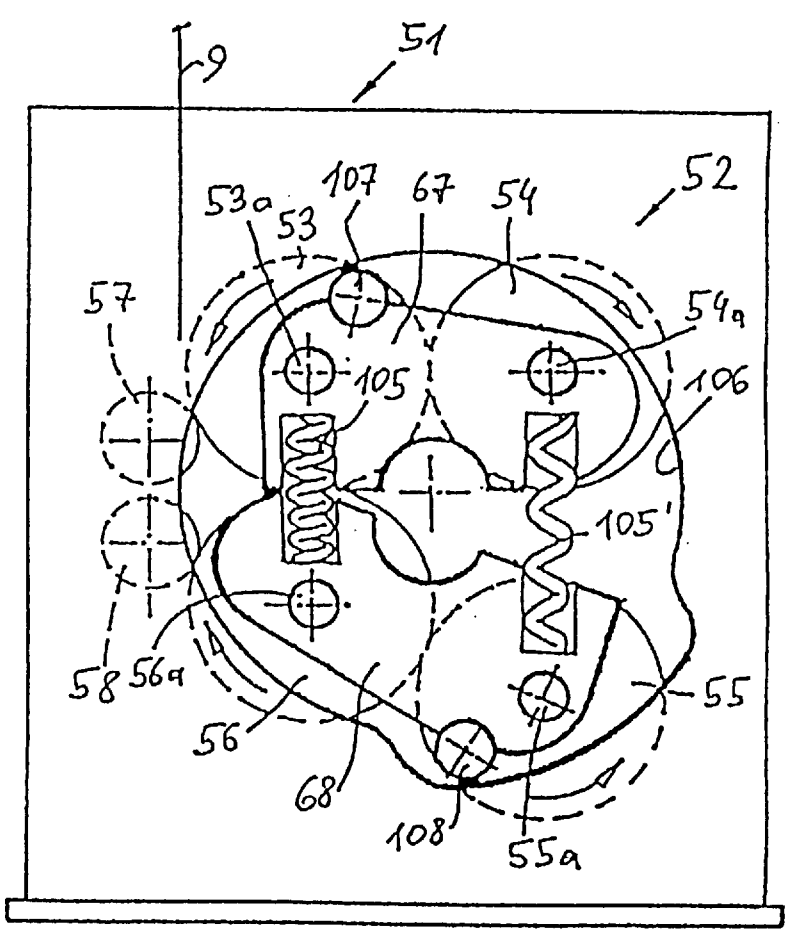
Figure 11:
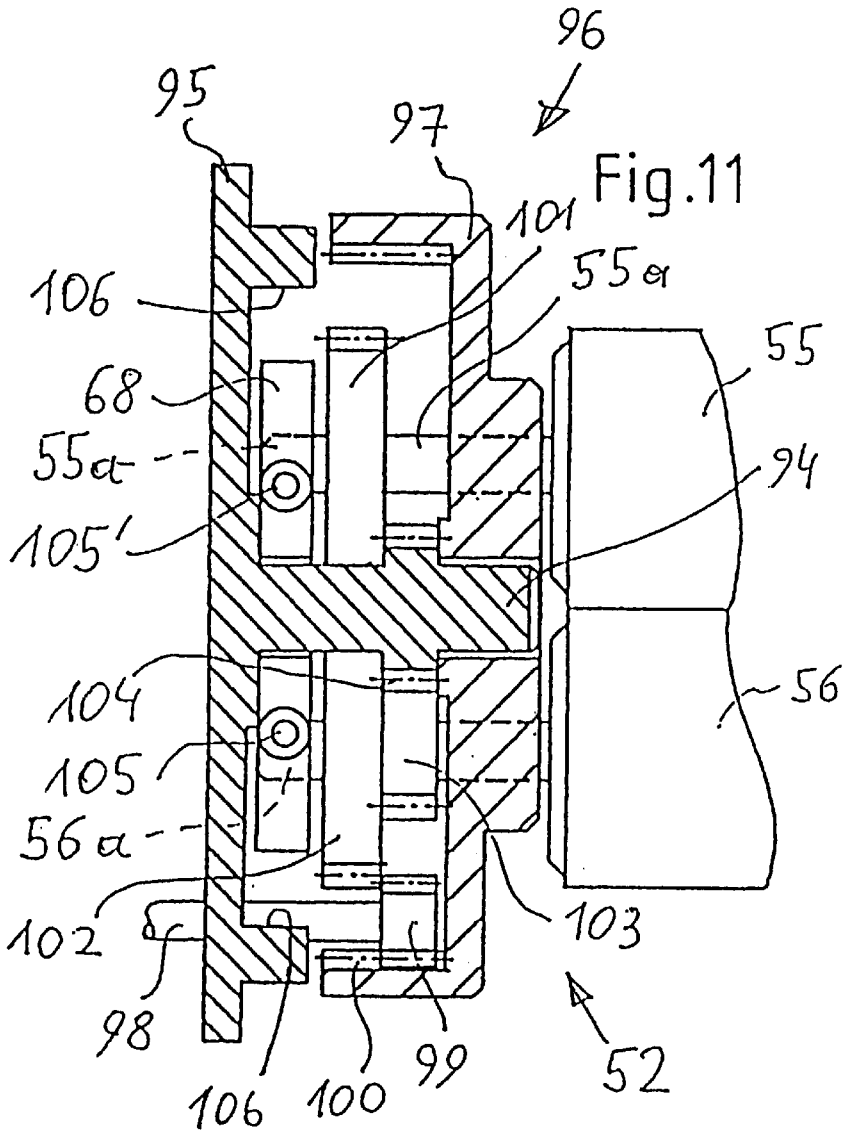

In the illustrative embodiment of the buckle folding machine which is shown in FIGS. 10 and 11 each of the two rotary head of the rotary frame 52 which carries the working cylinders 53, 54, 55, 56 is rotatably mounted on a rigid rotary head axle 94 of a side wall 95 of the machine frame 51. FIG. 11 shows the driving rotary head 96 of that rotary frame 52. That driving rotary head 96 comprises a frame disk 97, which is adjacent to the ends of the working cylinders 53, 54, 55, 56 and through which the journals 53*a*, 54*a*, 55*a*, 56*a* extend. The frame disk 97 is driven by a motor, not shown, via a drive pinion 99, which is mounted on the drive axle 98 and meshes with a gear 100, which is secured to the frame disk 97.

Drive is transmitted from the frame disk 97, which is rotated by the drive pinion 99, to the drive gear for the working cylinders by means of a gear 103, which is parallel to a drive gear 102 and is also mounted on the journal 56*a* of the working cylinder 56 and meshes with a stationary gear 104, which is mounted on the rigid rotary head axle 94.

Each of the two rotary head of the rotary frame 52 comprises two pivoted U-shaped members 67, 68, in each of which the journals 53*a* and 54*a* or 55*a* and 56*a* of two adjacent working cylinders 53 and 54 or 55 and 56 are rotatably mounted. The pivoted U-shaped member 67 in which the journals 53*a* and 54*a* are rotatably mounted is rotatably movable about the journal 54*a*. The pivoted U-shaped member 68 in which the journals 55*a* and 56*a* are rotatably mounted is pivotally movable about the journal 56*a*. The pivotal movement of the two pivoted levers 67, 68 and the accompanying pivotal movement of the two pivoted working cylinders 53 and 55 are controlled by two compression springs 105, 105', which are provided between the two pivoted levers 67, 68 and urge them apart at opposite ends, and by a cam track 106 , which surrounds the two pivoted levers 67, 68 on the outside and is closed in itself and is directed toward the axis of rotation of the rotary frame and is in sliding engagement with control elements 107, 108, which are mounted on the pivoted levers 67, 68.

Figure 14:
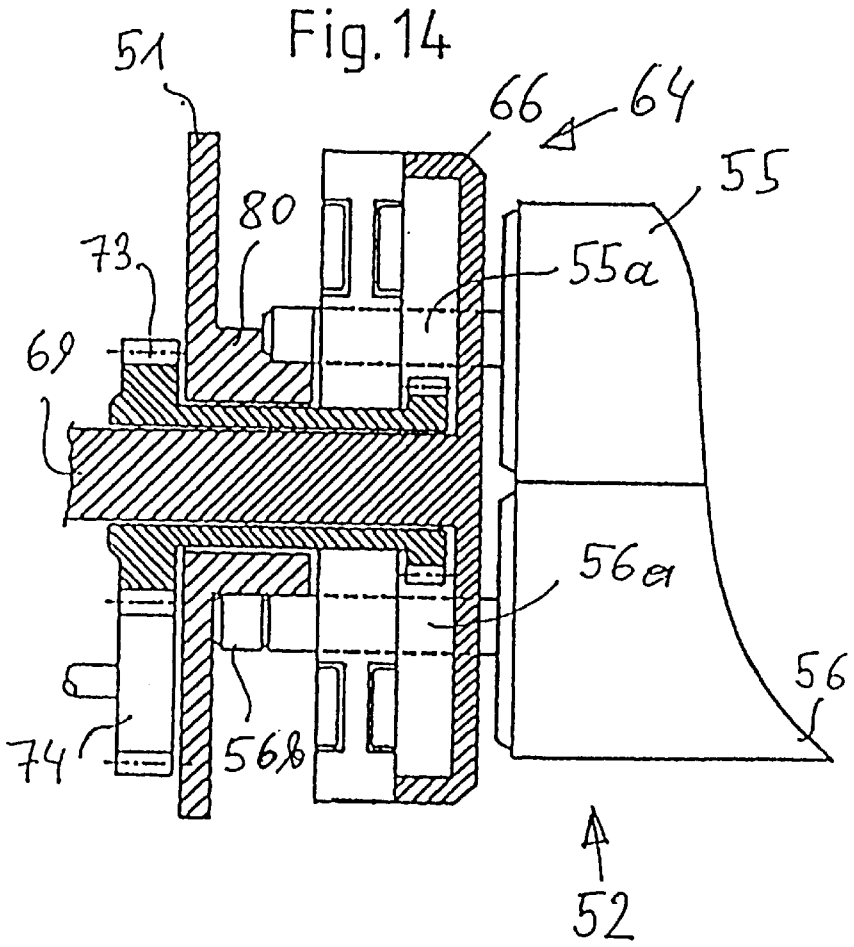
FIG. 14 shows the drive end of the buckle folding machine of FIG. 12.
Figure 13:
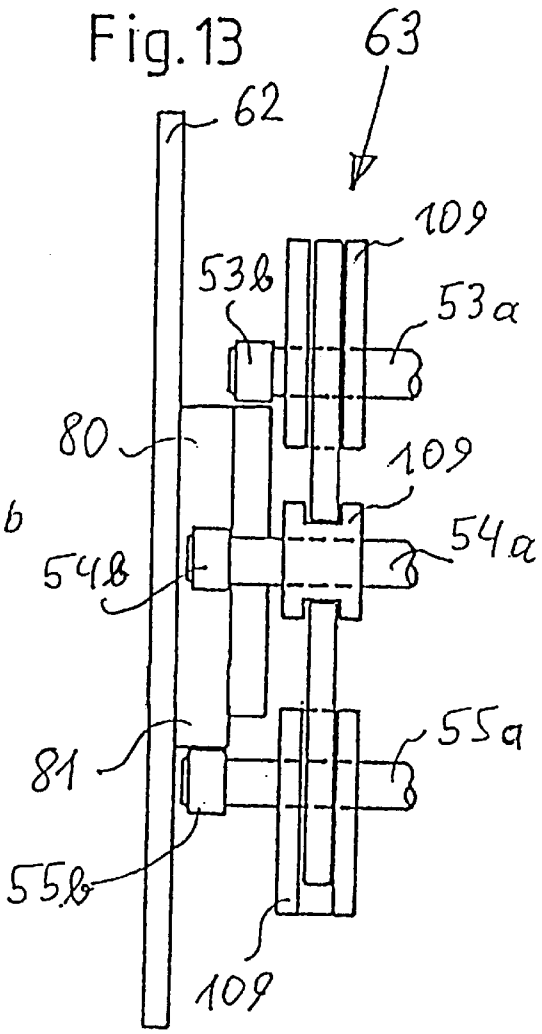
Figure 12:
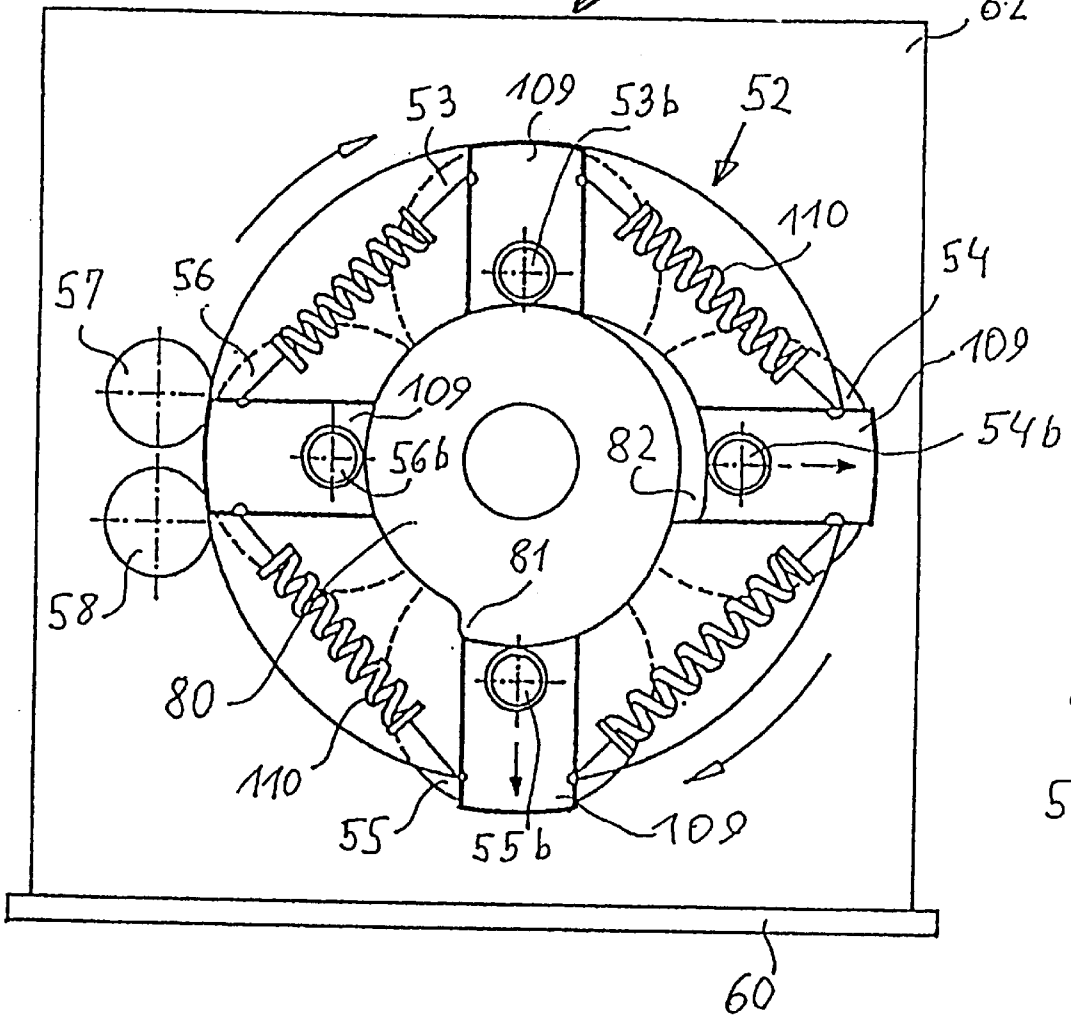

FIGS. 12 to 14 show a further embodiment of a buckle folding machine in accordance with the invention. Just as the embodiment shown in FIGS. 8 to 11 that embodiment comprises a stationary machine frame 51 with a displaceably mounted drawing-in roller 58 for the material 9 to be folded, and a rotary frame 52, which rotates in the machine frame 51 about an axis of rotation, which is stationary with respect to the machine frame. That rotary frame consists of two lateral rotary head 63, 64, in which the journals 53*a*, 54*a*, 55*a*, 56*a* are rotatally mounted which are provided at the ends of the four parallel working cylinders 53, 54, 55, 56, which have the same outside diameter. The two lateral rotary heads 63, 64 are provided with radially extending guideways for guide elements, which constitute radially displaceable carriages 109 and in which the journals 53*a*, 54*a*, 55*a*, 56*a* of respective working cylinders 53, 54, 55, 56 are individually rotatably mounted. The carriages 109 are arranged in a star-shaped configuration about the axis of rotation of the rotary frame and are interconnected in pairs by tension springs 110, which pull the carriages 109 radially inwardly toward the axis of rotation of the rotary frame. The journals 53*a*, 54*a*, 55*a*, 56*a* of the working cylinders 53,54, 55, 56 extend axially through the carriages 109 and on their end portions which laterally protrude from the carriages 109 carry rollers 53*b*, 54*b*, 55*b*, 56*b*, which constitute control elements, which serve to radially displace the carriages 109 and bear on an outwardly facing guiding surface of a spreading element 79, which just as in the illustrative embodiment shown in FIGS. 8 and 9 is mounted on a sleevelike extension 80, which protrudes inwardly from the side plate 62 of the stationary frame 51. The spreading element 79 comprises two spreading cams 81, 82. FIG. 14 shows the driving rotary head 64, which carries the carriages 109 and which does not differ from the driving rotary head of FIG. 8 as regards the transmission of the drive from the driving pinion 74 via the gears 72, 73 mounted on the tubular shaft of the drive gears (not shown), which are mounted on the journals of the working cylinders.

In the illustrative embodiment shown in FIG. 12 to 14 the working cylinders 53, 54, 55, 56 are displaced in that carriages 109 are radially displaced in the frame disk 65, 66 of the rotary head 63, 64 against the action of the tension springs 110. That radial displacement of the carriages 109 is derived by the guide rollers 53*b*, 54*b*, 55*b*, 56*b* from the spreading element 79 and particularly from its cams 81, 82. The gears for driving the working cylinders 53, 54, 55, 56 are suitably so designed that the drive gears are not disengaged and are not seized in spite of the fact that the displacement of the carriages will result in a slight increase of the distance between the axes by about the maximum thickness of the material 9 to be folded. In larger folding machines and when the material to be folded is thick the working cylinders may be driven by timing belts on the like. It will be understood that the rotary head 63 or the driving rotary head 64 of the buckle folding machine of FIGS. 12 to 14, which rotary head comprises the radially movable carriages 109, in which the journals 53*a*, 54*a*, 55*a*, 56*a* of the working cylinders 53, 54, 55, 56 are mounted, may be rotatably mounted like the driving rotary head 96 of FIG. 11 on a rigid axle, which is immovably mounted on the stationary frame 51.

Figure 24:
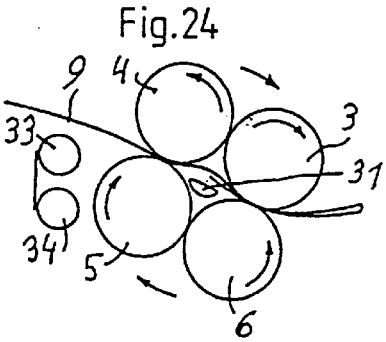
Figure 25:
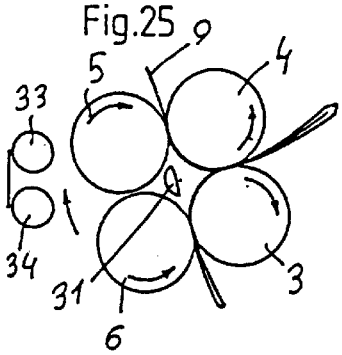
Figure 26:
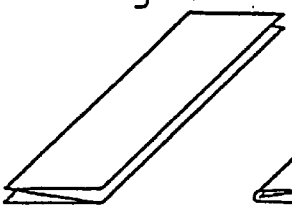
FIG. 26 shows a zigzag fold and FIG. 27 a parallel fold.
Figure 27:
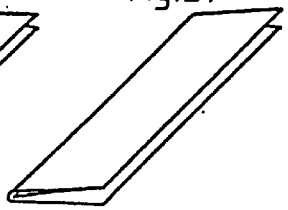

FIGS. 16 to 23 show consecutive positions of the rotary frame of a paper-folding machine in accordance with the invention in consecutive positions assumed during the folding of a zigzag fold (FIGS. 16 to 21, 23) and a parallel fold (FIGS. 16 to 20, 22) during a working revolution through 360° (FIGS. 16 to 23) and during a working revolution through 180° (FIGS. 24, 25) of the rotary frame. FIG. 26 shows a zigzag fold, FIG. 27 a parallel fold. For the sake of clearness, only the positions of the four working cylinders relative to each other and relative to the forwarding rollers and the positions of the material to be folded and of the rejector for rejecting the material to be folded are shown.

In dependence of the requirements, various designs of the means of controlling the two following stations and of a given folding machine may be adopted in various embodiments of the buckle folding machine in accordance with the invention.

For instance, a buckle folding machine may be provided with strictly mechanical control means, with a stationary spreading cam on a rigid rotary head axle with a positive coupling between the working cylinders and the rotary frame in conjunction with a constant transmission ratio between the speed of the working cylinders and the speed of the rotary frame, and with a rigid locating mark. That embodiment can be used only to fold material having a uniform size and with fold legs having constant lengths.

Figure 16:
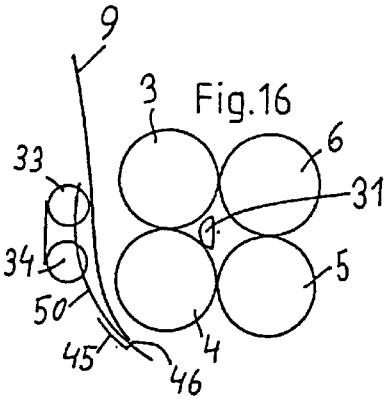
FIGS. 16 to 23 are schematic representations of the consecutive positions assumed in a buckle folding machine in accordance with the invention together with the material to be folded during a folding through 360° and FIGS. 24 and 25 show cylinder positions during a folding through 180°.
Figure 19:
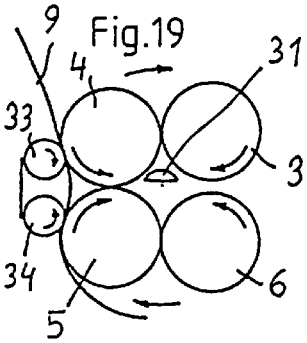

In that case paper is introduced as far as to the locating mark 46, whereafter a sensor for detecting the material to be folded starts the drive (FIG. 16). The peripheral surface 35 of the frame disks constitutes a guiding surface and permits a pivotal movement of the forwarding rollers 33 and 34 toward the rotary frame, where the material to be folded, which extends between the forwarding rollers and the working cylinder 4, is forwarded into the folding apparatus because the working cylinder 4 engages the forwarding roller 34 (FIG. 17). Owing to the constant transmission ratio between the working cylinders and the rotary frame, the continued rotation of the rotary frame will cause the working cylinder 5 to engage the forwarding roller 34 exactly at that point to which the paper must be returned opposite to the forward direction in conjunction with the oppositely driven working cylinder 4 and forwarding roller 33 in order to form the first folding loop and to cause said loop to be received by the working cylinders 4 and 5,(FIG. 19).

Figure 20:
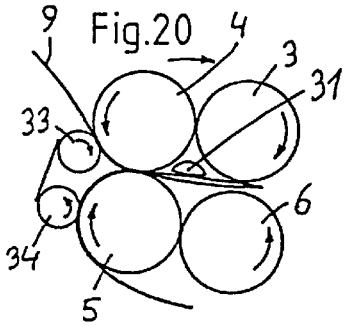
Figure 23:
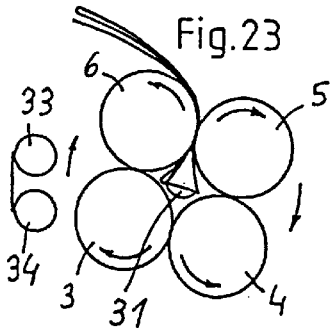
Figure 21:
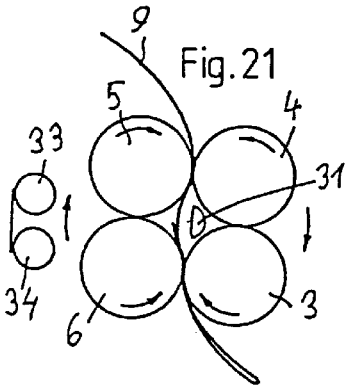

The working cylinders 3 and 6 have been moved apart in the meantime by the spreading cams 8 and permit a resumption of the forward movement of the material 9 to be folded with the first folded fold on the front side (FIG. 20). Because the transmission ratio is constant, the continued rotation of the rotary frame 2 with the four working cylinders 3, 4, 5, 6 on the rigid rotary head axles 21, 22 the two working cylinders 3 and 6 after passing the stationary spreading cams 8 are swung against each other again exactly at that point to which the material to be folded must be returned to form the second folding loop in conjunction with the pair of working cylinders 4, 5 driven in opposite senses (FIG. 21). In dependence of the position of the rejector 31 for rejecting the material to be folded that material will be received by the pair of working cylinders 5, 6 (FIG. 21) or 3, 4 (FIG. 22) and the resulting fold will be a parallel fold (FIG. 22) or a zigzag fold (FIG. 21).

Adjustable control means will be required for a folding of different paper sizes which require fold legs differing in length. In such an embodiment the transmission ratio between the working cylinders and the rotary frame is also constant but the locating mark 46 provided with the sensor 46' for detecting the material to be folded and the spreading cams 8, which are either rotatably mounted on the rigid rotary head axles 21, 22 (FIG. 5) or are mounted on the rotary head axles 21, 22 which are rotatably mounted in the stationary frame, are manually adjustable. If a larger size is to be folded, the locating mark 46 will be moved away from the first folding location exactly by that distance by which the first leg of the folded material is larger than that leg formed by the folding of the smaller paper. Because the sequence of movements of the rotary frame 2 and the forwarding rollers 33, 34 is fixed, the first folding loop will always be formed at the same location in the drawing-in shaft 41 of the folding apparatus.

Because the spreading cams 8 can also be moved in the direction of rotation of the rotary frame 2 and, as a result, the working cylinders 3, 6 are swung against each other at a later time, the second fold leg will also be longer if the transmission ratio between the working cylinders and the rotary frame is constant.

If a programmable control is provided, in which paper sizes can be stored as well as fold leg lengths which can be selected independently of the paper sizes, the drive of the working cylinders 3, 4, 5, 6 can be uncoupled from the drive for the rotary frame 2.

In that embodiment the locating mark 46 and the spreading cams 8 as well as the rotary head axles 21, 22 are rigidly mounted. The control is effected by a control magnet, which uncouples the drive for the rotary frame 2 from the drive for the working cylinders 3, 4, 5, 6. In case of a larger paper size, the drive for the rotary frame is briefly interrupted, e.g., for the first fold leg, which is no longer, while the paper is drawn in by the working cylinder 4 to the extent of the longer first fold leg. The first folding station is still at the same location. To make the second fold, the drive for the rotary frame 2 is also briefly interrupted before the rigid spreading cams 8 are passed and the paper is drawn in by the working cylinders 4, 5 to the larger extent of the second fold leg.

Whereas a control magnet and the associated electronic control are required in that embodiment, it does not require fold plates and plurality of electromagnets for actuating the feed limiters.

I claim:

1. A buckle folding machine for folding material, which comprises (a) a stationary machine frame, (b) a rotary frame revolvable with the stationary machine frame about a rotary frame axis, the rotary frame comprising (1) four adjacent working cylinders comprising journals, (2) the working cylinders having the same outside diameters, being arranged around the rotary frame axis, being rotatable about their own axes in opposite directions and at the same speed, and defining roll nips, one of the roll nips defining a first folding nip for folding the material once and at least one further roll nip for folding the material once more, (3) the working cylinders functioning as cylinders for drawing in the material, as cylinders for buckling the drawn-in material to form loops, as cylinders for flattening the loops into folds, and as cylinders for ejecting the folded material, (4) at least one of the working cylinders forming an openable and closeable roll nip with an adjacent one of the working cylinders and being positively displaceably arranged within the rotary frame relative to said adjacent working cylinder, (5) two opposite rotary heads comprising journal guide elements receiving the journals, (6) the rotary heads being rotatably mounted within said stationary machine frame and disposed at opposite ends of said working cylinders, each rotary head comprising at least one journal guide element receiving the journal of a working cylinder displaceable within the rotary head against the force of at least one spring, and (7) a common transmission arranged in the rotary frame for rotating the working cylinders, at least one rotary head being a driving rotary head comprising said common transmission for driving said working cylinders revolving with said rotary frame, (c) a mechanical control device for positively displacing the at least one working cylinder within the rotary frame relative to the adjacent working cylinder for opening and closing the roll nip and for changing the function of the working cylinders defining said roll nip, (d) a rotary frame drive means for revolving the rotary frame and for drawing in, folding and ejecting the material by the rotating working cylinders, and (e) drawing-in means arranged within the stationary frame adjacent the rotary frame for cooperating with the rotary frame and the working cylinders for drawing in and folding the material in the first folding nip.

2. The machine of claim 1, further comprising a transfer transmission for transmitting the drive from said rotary frame to said working cylinders, said transfer transmission comprising a stationary machine frame gear coaxial with said rotary frame axis and at least one working cylinder driving gear of said common transmission meshing with said stationary machine frame gear for driving said working cylinders by the revolving rotary frame.

3. The machine of claim 1, further comprising a rotary frame drive shaft fixedly connected to said rotary frame and a working cylinder drive shaft arranged coaxially to said rotary frame drive shaft and carrying a gear meshing with at least one working cylinder driving gear of said common transmission for driving said working cylinders revolving with said rotary frame.

4. The machine of claim 3, further comprising a clutch disengageably interconnecting said rotary frame drive shaft and said working cylinder drive shaft.

5. The machine of claim 1, further comprising a working cylinder drive shaft being rotatable relative to said rotary frame and carrying a gear meshing with at least one working cylinder driving gear of said common transmission for driving said working cylinders.

6. The machine of claim 5, wherein said working cylinder drive shaft is adapted to be coupled with said rotary frame drive means.

7. The machine of claim 1, further comprising a machine frame enclosure surrounding said rotary frame, forming a guide for the material to be folded and leaving free only a region for drawing in the material to be folded and for ejecting the folded material.

8. The machine of claim 1, wherein each rotary head comprises a frame disk arranged between the journal guide elements of the rotary head and the working cylinders penetrating the frame disk with their journals arranged in the journal guide elements of the rotary head arranged on a side of the frame disk facing away from the working cylinders.

9. The machine of claim 1, wherein said driving rotary head comprises a frame disk arranged between said common transmission and the working cylinders penetrating the frame disk with their journals, said common transmission comprising working cylinder driving gears carried by the journals on a side of the frame disk facing away from the working cylinders.

10. The machine of claim 1, wherein said journal guide elements are carriages substantially radially displaceable within said rotary head.

11. The machine of claim 1, wherein said journal guide elements are pivoted levers having a pivotal axis extending parallel to said rotary frame axis.

12. The machine of claim 11, wherein a respective one of the pivoted levers containing the journal of one of the working cylinders is pivotal about the journal of an adjacent one of the working cylinders.

13. The machine of claim 1, wherein each journal guide element is a tiltable disk-like element being tiltable about at least one pivot eccentric to the working cylinder journal of said journal guide element.

14. The machine of claim 1, comprising a spring interconnecting two adjacent journal guide elements of one rotary had.

15. The machine of claim 1, comprising a common spring interconnecting all journal guide elements of one rotary head.

16. The machine of claim 15, wherein the common spring extends along the outside of the journal guide elements of said rotary head and consists of an endless ring of elastic material.

17. The machine of claim 1, wherein said mechanical control device comprises a control element associated with the journal guide element of the positively displaceable working cylinder and a cam means extending coaxially with said rotary frame axis and having at least one cam track portion engageable with said control element for displacing said displaceable working cylinder within said rotary frame.

18. The machine of claim 17, wherein said cam means is a camwheel stationary with respect to said stationary machine frame.

19. The machine of claim 17, wherein said cam means is a camwheel adapted to be stopped with respect to said machine frame.

20. The machine of claim 17, wherein said cam means is a cylinder coaxial with said rotary frame axis and carrying said at least one cam track portion on a spreading cam protruding outwardly from said coaxial cylinder.

21. The machine of claim 17, wherein said mechanical control device comprises a control element for displacing two adjacent ones of the working cylinders within said rotary frame, said control element consisting of a spreading element simultaneously engageable with said cam track portion of said cam means and said journal guide elements associated with said two adjacent working cylinders for moving said journal guide elements and said two adjacent working cylinders apart.

22. A buckle folding machine for folding material, which comprises (a) a stationary machine frame, (b) a rotary frame revolvable within the stationary machine frame about a rotary frame axis, the rotary frame comprising (1) four adjacent working cylinders having the same outside diameters and being arranged around the rotary frame axis, the working cylinders being rotatable about their own axes in opposite directions and at the same speed, and defining four roll nips, one of the roll nips defining a first folding nip for folding the material once and at least one further roll nip for folding the material once more, (2) the working cylinders functioning as cylinders for drawing in the material, as cylinders for buckling the drawn-in material to form loops, as cylinders for flattening the loops into folds, and as cylinders for ejecting the folded material, (3) at least one of the working cylinders forming an openable and closeable roll nip with an adjacent one of the working cylinders and being positively displaceably arranged within the rotary frame relative to said adjacent working cylinder, and (4) a common transmission arranged in the rotary frame for rotating the working cylinders, (c) a mechanical control device for positively displacing the at least one working cylinder within the rotary frame relative to the adjacent working cylinder for opening and closing the roll nip and for changing the function of the working cylinders defining said roll nip, (d) a rotary frame drive means for revolving the rotary frame and for drawing in, folding and ejecting the material by the rotating working cylinders, (e) drawing-in means arranged within the stationary machine frame adjacent the rotary frame for cooperating with the rotary frame and the working cylinders for drawing in and folding the material in the first folding nip, and (f) comprising a rejector associated with said further folding nip defined by said working cylinders and protruding into said rotary frame between said working cylinders for rejecting the material to be folded.

23. The machine of claim 22, wherein said rejector is fixable to the machine frame in different angular positions.

24. The machine of claim 22, wherein said rejector is fixable to said rotary frame in different angular positions.

25. A buckle folding machine for folding material, which comprises (a) a stationary machine frame, (b) a rotary frame revolvable within the stationary machine frame about a rotary frame axis, the rotary frame comprising (1) four adjacent working cylinders having the same outside diameters and being arranged around the rotary frame axis, the working cylinders being rotatable about their own axes in opposite directions and at the same speed, and defining four roll nips, one of the roll nips defining a first folding nip for folding the material once and at least one further roll nip for folding the material once more, (2) the working cylinders functioning as cylinders for drawing in the material, as cylinders for buckling the drawn-in material to form loops, as cylinders for flattening the loops into folds, and as cylinders for ejecting the folded material, (3) at least one of the working cylinders forming an openable and closeable roll nip with an adjacent one of the working cylinders and being positively displaceably arranged within the rotary frame relative to said adjacent working cylinder, and (4) a common transmission arranged in the rotary frame for rotating the working cylinders, (c) a mechanical control device for positively displacing the at least one working cylinder within the rotary frame relative to the adjacent working cylinder for opening and closing the roll nip and for changing the function of the working cylinders defining said roll nip, (d) a rotary frame drive means for revolving the rotary frame and for drawing in, folding and ejecting the material by the rotating working cylinders, (e) drawing-in means arranged within the stationary machine frame adjacent the rotary frame for cooperating with the rotary frame and the working cylinders for drawing in and folding the material in the first folding nip, the drawing-in means comprising (1) two forwarding rollers movably arranged with said stationary machine frame, the forwarding rollers being resiliently biased towards said rotary frame and being pressable against said working cylinders.

26. The machine of claim 25, wherein said two forwarding rollers are rotatably mounted in a pressure-applying frame movably guided within said stationary machine frame and resiliently biased towards said rotary frame, said pressure-applying frame carrying lateral guide rollers for engaging pressure-applying frame guiding surfaces on outwardly facing peripheral surfaces of said rotary frame.

27. The machine of claim 26, wherein said pressure-applying frame guiding surfaces comprise cam portions associated with said further folding nip defined by said working cylinders for keeping said forwarding rollers away from said working cylinders defining said further folding nip.

28. The machine of claim 26, wherein said drawing-in means further comprises a material drawing-in shaft arranged between an outer guide member provided within said stationary machine frame and an inner guide member revolving with said rotary frame and being provided on said rotary frame on an edge portion associated with said further folding nip defined by said working cylinders.

29. The machine of claim 28, wherein said outer guide member of said material drawing-in shaft is connected to said pressure-applying frame.

30. The machine of claim 25, wherein said drawing-in means further comprises a locating mark for locating the material to be folded.

31. The machine of claim 30, further comprising a sensor associated with said locating mark for detecting the material to be folded.

32. The machine of claim 30, further comprising a U-shaped stop member carrying said locating mark, the U-shaped stop member being pivotal about said rotary frame axis and fixable within said stationary machine frame.

33. The machine of claim 32, wherein the mechanical control device comprises a rotatable camwheel, further comprising a transmission connecting said pivotal U-shaped stop member with said rotatable camwheel for simultaneously adjusting the length of the legs of the folded material at the first and further folding nips.

* * * * *